US009604098B2

(12) United States Patent
Huang et al.

(10) Patent No.: US 9,604,098 B2
(45) Date of Patent: Mar. 28, 2017

(54) EXERCISE DEVICE

(71) Applicant: Dyaco International Inc., Taipei (TW)

(72) Inventors: Hsuan-Fu Huang, Taipei (TW); Han-Lin Liu, Taipei (TW)

(73) Assignee: Dyaco International Inc., Taipei (TW)

( * ) Notice: Subject to any disclaimer, the term of this patent is extended or adjusted under 35 U.S.C. 154(b) by 0 days.

(21) Appl. No.: 14/824,988

(22) Filed: Aug. 12, 2015

(65) Prior Publication Data

US 2017/0036062 A1 Feb. 9, 2017

(30) Foreign Application Priority Data

Aug. 3, 2015 (TW) ..... 104125117 A

(51) Int. Cl.
*A63B 21/00* (2006.01)
*A63B 22/04* (2006.01)

(52) U.S. Cl.
CPC ..... *A63B 22/04* (2013.01)

(58) Field of Classification Search
CPC ..... A63B 21/00
USPC ..... 482/51, 52
See application file for complete search history.

(56) References Cited

U.S. PATENT DOCUMENTS

2001/0036886 A1 11/2001 Eschenbach
2015/0087481 A1* 3/2015 Liu ..... A63B 22/0664 482/52
2015/0202490 A1* 7/2015 Long ..... A63B 22/001 482/52
2015/0335942 A1* 11/2015 Murray ..... A63B 22/201 482/52
2016/0375300 A1* 12/2016 Chang ..... A63B 22/0664 482/52

FOREIGN PATENT DOCUMENTS

TW I272955 B 2/2007
TW M505319 U 7/2015

OTHER PUBLICATIONS

Office Action Dated Jun. 28, 2016 in corresponding Taiwan Patent Application No. 104125117.

* cited by examiner

*Primary Examiner* — Jerome w Donnelly
(74) *Attorney, Agent, or Firm* — Donald E. Stout; Stout, Uxa & Buyan, LLP

(57) ABSTRACT

An exercise device comprises a frame, two pedals, two first swing arms, two second swing arms, a resistance device, two link rods, two cranks, two limiting rods, and a stride-adjusting device. Each first swing arm has two ends, in which one end pivotally connects to the frame, and the other connects to one second swing arm. Each second swing arm has two ends, in which one end connects to one first swing arm, and the other connects to one pedal. Each crank includes an end connecting to an axle of the resistance device and another end connecting to one link rod. Each link rod includes two ends, in which one end connects to one crank, and the other connects to an area of one second swing arm. Each pedal sildely couples with one corresponding limiting rod, and an end of each limiting rod movably couples with the stride-adjusting device.

12 Claims, 13 Drawing Sheets

EXERCISE DEVICE

CROSS-REFERENCE TO RELATED APPLICATIONS

The entire contents of Taiwan Patent Application No. 104125117, filed on Aug. 3, 2015, from which this application claims priority, are expressly incorporated herein by reference.

BACKGROUND OF THE INVENTION

1. Field of the Invention

The present invention relates to an exercise device, and more particularly relates to an exercise device providing ergonomic paths and variable strides.

2. Description of Related Art

Without limiting the disclosed embodiments, a stair stepper, is an exercise device to elevate the heart rate, burn calories and improve cardiovascular endurance.

On a typical stair stepper, a user stands on two platforms supported by a given level of resistance. The user lifts alternating feet, as if walking up a set of stairs, so as to build muscle in legs and gluteus. The stair stepper is also a lower-impact training machine compared to a treadmill, making it useful for those with leg injuries. However, the stair stepper should be used with caution because inadequately activating will place additional stress on the knees.

FIG. 1A and FIG. 1B show two conventional stair steppers. FIG. 1 shows a convention stair stepper with an axis 21 and a pedal 20 coupling with the axis 21 via a rod 22, so that the pedal 20 moves along a path P. FIG. 2 shows another conventional stair stepper with two axis 21 and a pedal 20 coupling with the two axis 21 via two rods 22, so that the pedal 20 moves along a path P. Noticed that the both paths P are an arc with a center pointing away the user, and the paths P are not ergonomic and thus cannot simulate the real stepping, striding, or stair-climbing.

US patent US20120077645 discloses a stair stepper, in which the crank arm exerts force to the linking units, so that the pedal link coupled with the linking units can be moved forward and backward. Each pedal link has a rollable anti-friction member to pivotally couple with the pedal. When the pedal link is moved forward, the rollable anti-friction member drags the pedal climbing forwardly and upwardly along the ramp rod. However, the climbing force of the pedals is unsufficient, and thus the design is not a good solution to simulate stepping, striding, or stair-climbing.

The detail of conventional steppers can also refer to Taiwan patent I458519, entitled "adjustable stepper," and Taiwan patent I442955, entitled "stepper," the entire contents of the foregoing applications are incorporated herein for reference.

In addition, conventional steppers typically suffer from a "dead point" problem. The dead point is a point that when a crank and a link of a linking mechanism are operated to be overlapped, it is difficult to further move the crank.

SUMMARY OF THE INVENTION

In one general aspect, the present invention relates to an exercise device having ergonomic paths and variable strides and being designed to overcome the "dead point" problem.

In an embodiment of the present invention, an exercise device is provided with a frame, two pedals, two first swing arms, two second swing arms, a resistance device, two link rods, two cranks, two limiting rods, and a stride-adjusting device. The two first swing arms are respectively arranged at a left side and a right side of the frame, each first swing arm having a first end pivotally coupling with the frame. The two second swing arms couple with the two first swing arms, each first swing arm having a second end pivotally coupling with a first end of one corresponded second swing arm. The two pedals couple with the two second swing arms, each second swing arm having a second end coupling with one corresponded pedal. The resistance device is pivoted to the frame by an axle for providing a resistance. The two cranks are respectively arranged at a left side and a right side of the resistance device, each crank having a first end coupling with the axle of the resistance device. The two link rods couple with the two cranks and the two second swing arms, each link rod having a first end and a second end, the first end of each link rod coupling with a second end of one corresponded crank, the second end of each link rod coupling with a portion of one corresponded second swing arm. The two pedals slidably couple with two limiting rods, each limiting rod having a first end pivotally coupling with the frame. The stride-adjusting device has a first end coupling with the frame and a second end movably coupling with a second end of each of the two limiting rods.

In an embodiment, the stride-adjusting device comprises a motor, a screw, and a tube, the tube has internally thread to engage with the screw, and the motor can drive the screw to rotate, so that the tube is moved along the screw in a direction toward the motor or away from the motor.

In an embodiment, the frame comprises a base and a supporting structure, the base is arranged on a supporting plane or ground, and the supporting structure is arranged on the base.

In an embodiment, an end of the motor pivotally couples with the supporting structure of the frame, an end of the tube couples with a horizontal linkage, and an end of each of the two limiting rods couples with the horizontal linkage.

In an embodiment, the exercise device further comprises a first linkage, two second linkages, and a horizontal linkage, wherein an end of the motor pivotally couples with the base of the frame, a first end of the first linkage pivotally couples with the supporting structure of the frame, a second end of the first linkage pivotally couples with the tube, the two second linkages are respectively arranged at a left side and a right side of the first linkage, a first end of each of the two second linkages couples with a portion of the first linkage, a second end of each of the two second linkages couples with the horizontal linkage, a first end of each of the two limiting rods couples with the horizontal linkage, and a second end of each of the two limiting rods pivotally couples with the base of the frame.

In an embodiment, the exercise device of claim further comprises a plate, a track, and two rings, wherein an end of the motor pivotally couples with the base, the tube pivotally couples with the plate, the track is mounted on the base, and the plate is arranged on the track and can slide on the track, the two rings respectively couple to a left end and a right end of the plate, a first end of each of the two limiting rods pivotally couples with the supporting structure, and a second end of each of the two limiting rods passes through one of the two rings.

In an embodiment, the exercise device further comprises a plate and two rings, wherein an end of the motor pivotally couples with the base, the tube pivotally couples with the plate, the plate is arranged on the base and can slide on the base, the two rings respectively couple to a left end and a right end of the plate, a first end of each of the two limiting rods pivotally couples with the supporting structure, and a second end of each of the two limiting rods passes through one of the two rings.

In an embodiment, each limiting rod is arc-shaped with a center toward a portion of a user of the exercise device.

In an embodiment, the greater is an angle between the two limiting rods and a vertical direction, the shorter is a stride between the two pedals.

In an embodiment, the smaller is an angle between the two limiting rods and a vertical direction, the shorter is a stride between the two pedals.

In an embodiment, each pedal has an inclination, and the inclination of the pedal at the lowest position is smaller the inclination of the pedal at the highest position.

In an embodiment, the exercise device further comprises two roller assembly, and each roller assembly couples with one of the two second swing arms and silably couples with one of the two limiting rods, wherein each roller assembly comprises a front roller, a board structure, and a rear roller, the front roller and the rear roller are pivotally coupled with the board structure and are respectively arranged at a front and a rear of one corresponded limiting rod.

DETAILED DESCRIPTION OF THE PREFERRED EMBODIMENT

Figure 1A:
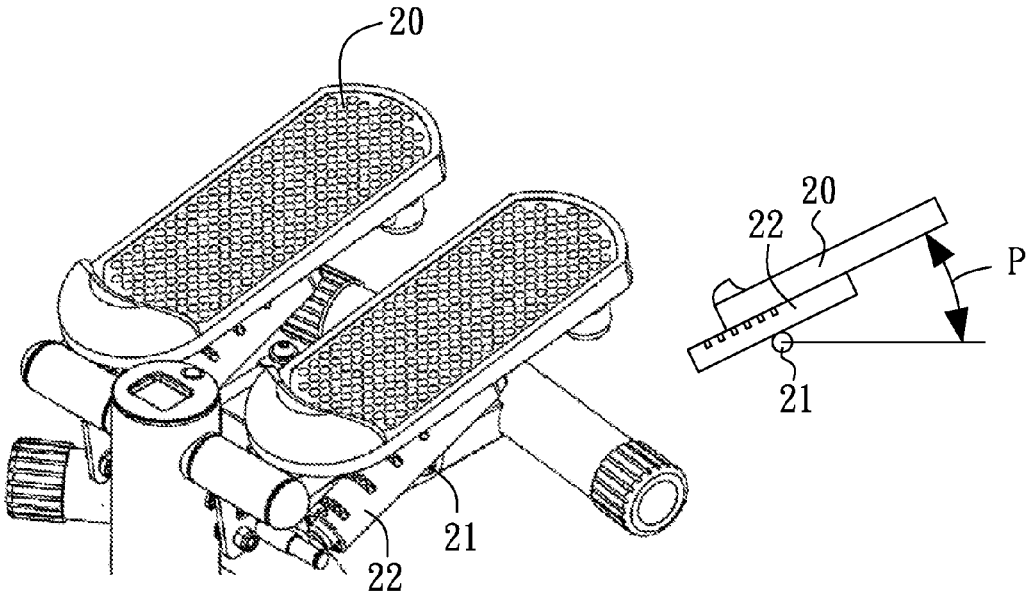
FIG.1A(Prior Art)
FIGS. 1A and 1B show two conventional stair steppers and their moving tracks.
Figure 1B:
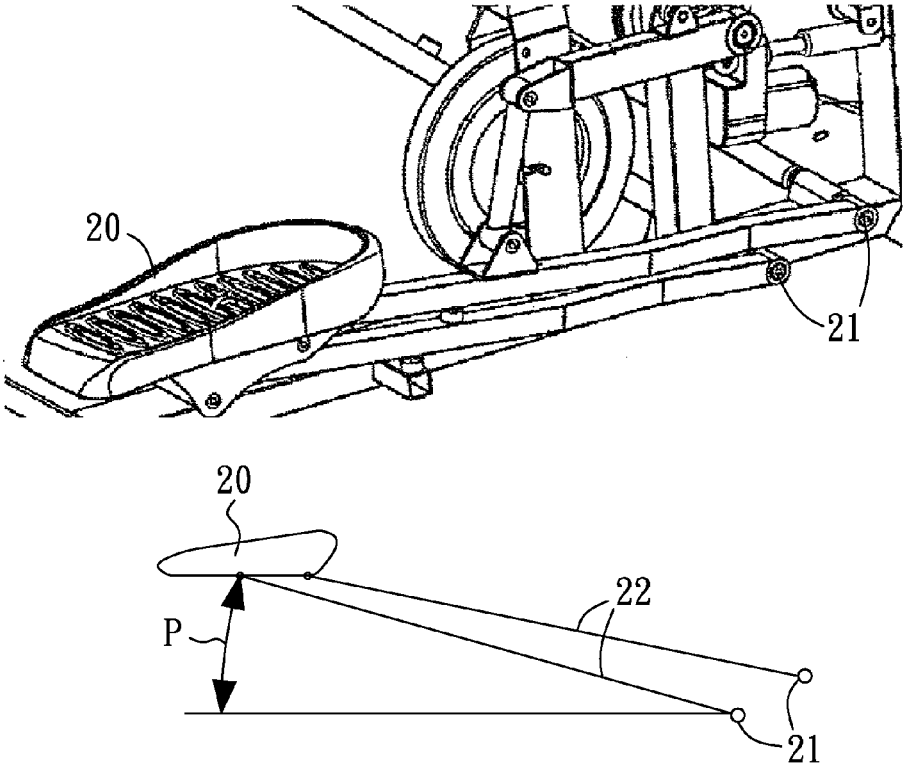
FIG.1B(Prior Art)

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
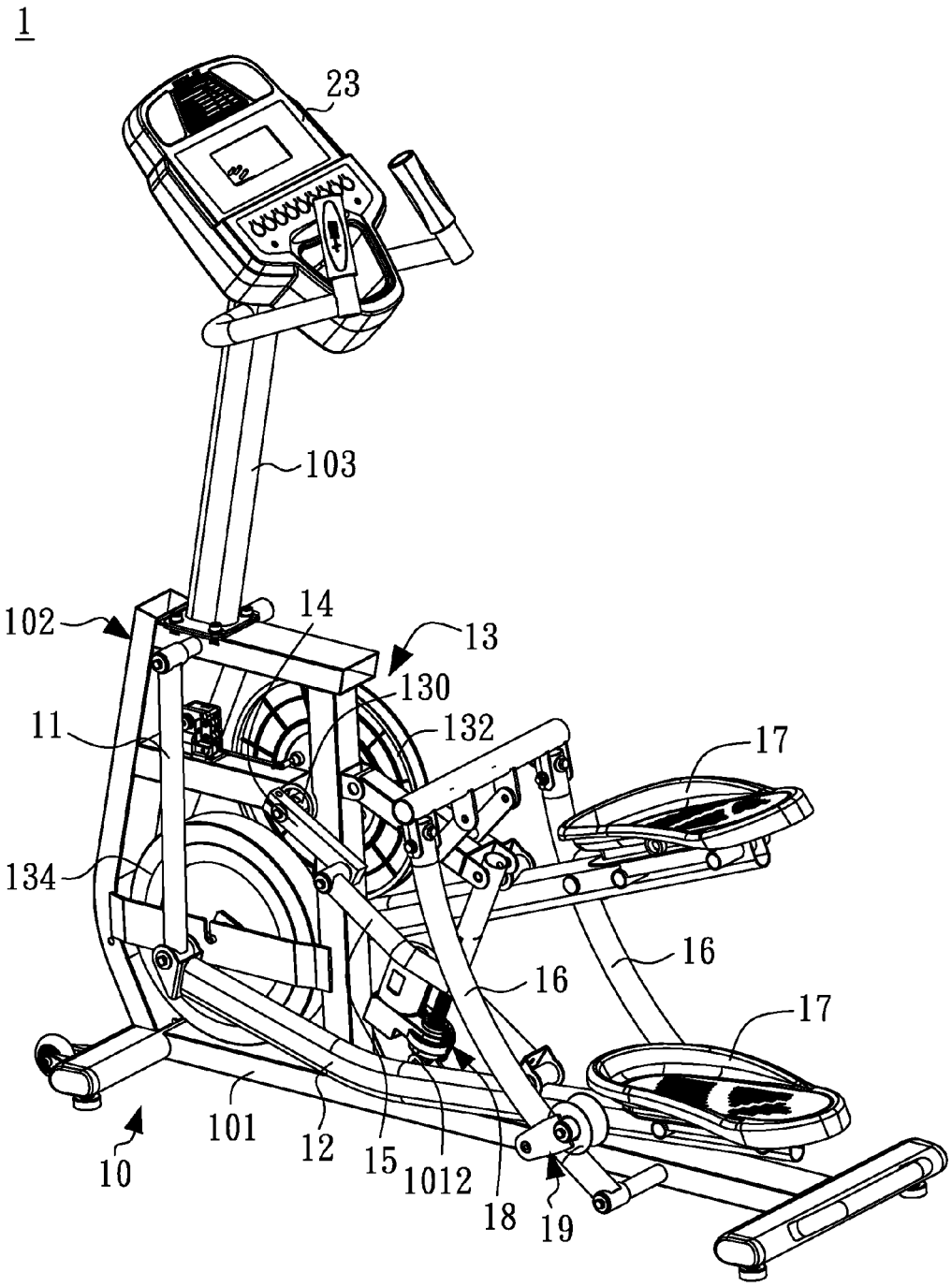
FIG. 2 is a perspective view showing an exercise device according to a first (preferred) embodiment of the present invention.
Figure 3:
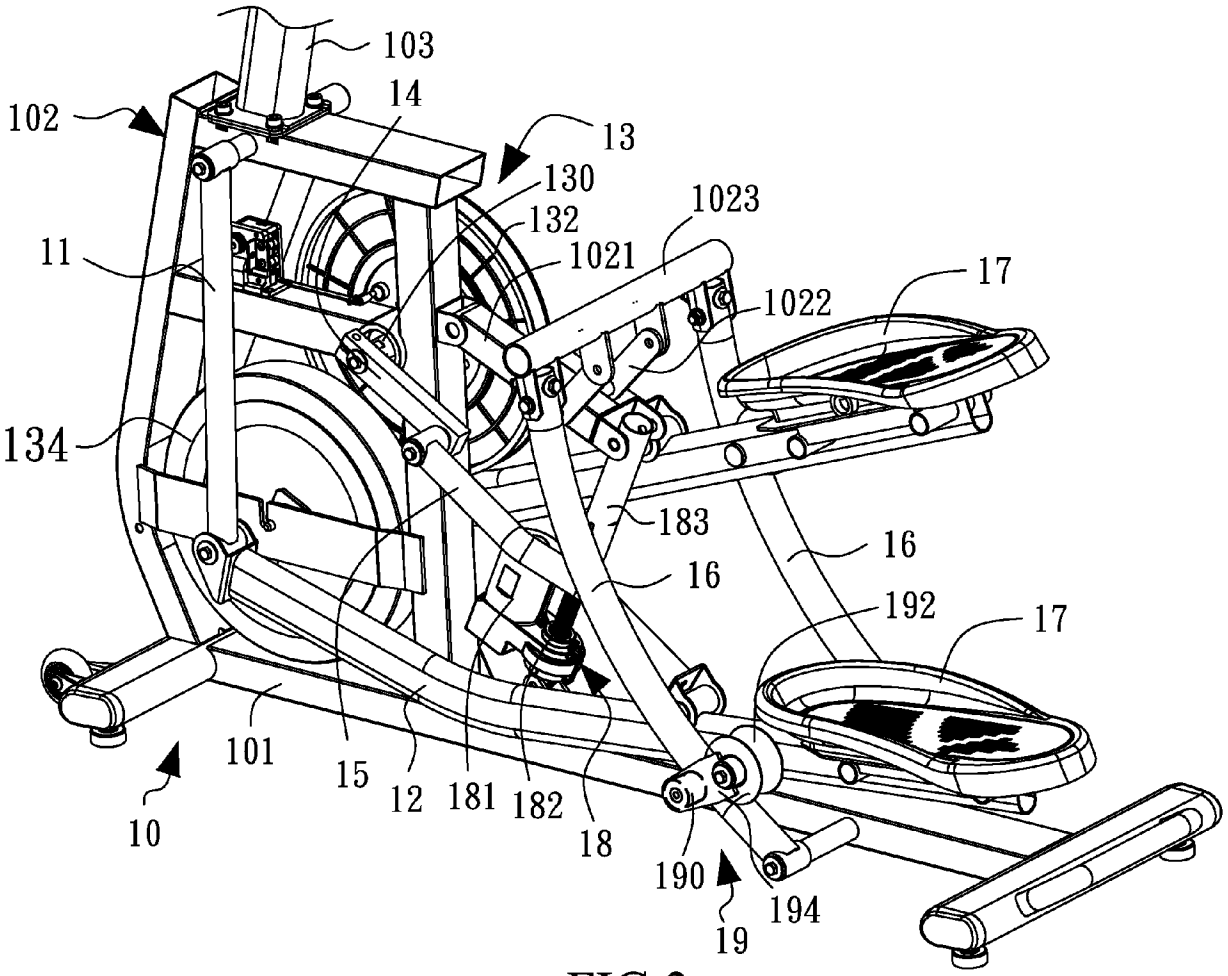
FIG. 3 is a partially perspective view showing the exercise device of FIG. 2.

FIGS. 2 and 3 are perspective and partially perspective view, respectively, showing an exercise device 1 according to a first (preferred) embodiment of the present invention. The exercise device 1 comprises a frame 10, two first swing arms 11, two second swing arms 12, a resistance device 13, two cranks 14, two link rods 15, two limiting rods 16, two pedals 17, and a stride-adjustment device 18.

Referring to FIGS. 2 and 3, both the two first swing arms 11 and the two second swing arms 12 are arranged at a left side and a right side of the frame 10, respectively. Each first swing arm 11 and each second swing arm 12 include two ends, a first end and a second end, in which the first end of the first swing arm 11 pivotally couples with the frame 10, and the second end of the first swing arm 11 pivotally couples with the first end of one corresponded second swing arm 12. And the second end of the corresponded second swing arm 12 couples with one corresponded pedal 17. In this preferred embodiment, the frame 10 may comprise, but is not limited to, a base 101 and a supporting structure 102. The base 101 is placed on a supporting plane or ground. The supporting structure 102 is arranged on the base 101. In this preferred embodiment, a post 103 may be arranged on the supporting structure 102, in which one end of the post 103 couples with the supporting structure 102, and the other end of the post 103 couples with an operating interface 23 allowing the user to control the exercise device 1.

Referring to FIGS. 2 and 3, the two cranks 14 are respectively arranged at a left side and a right side of the resistance device 13. The resistance device 13 comprises an axle 130, and each crank 14 and each link rod 15 include two ends, a first end and a second end. The first end of each crank 14 couples with the axle 130, and the second end of each crank 14 pivotally couples with the first end of one corresponded link rod 15. And the second end of the corresponded link rod 15 couples with or pivotally couples with a portion, e.g., a middle portion, of one corresponded second swing arm 12. In addition, each limiting rod 16 includes a first end and a second end, in which the first end movably couples with the stride-adjusting device 18, and the second end pivotally couples with the frame 10, e.g., pivotally coupling with the base 101 of the frame 10. The stride-adjusting device 18 is used to adjust an angle between the limiting rod 16 and the vertical direction, and the detail will be mentioned later.

Referring to FIGS. 2 and 3, when a user stands on two pedals 17, a resistance is given by the resistance device 13.

The operating interface 23 mounted above the frame 10 can determine the resistance. In this preferred embodiment, the resistance device 13 may comprise, but is not limited to, a driving wheel 132 and a flywheel 134. The driving wheel 132 has the axle 130 with bidirectional bearing (not shown) coupling with the first end of the two cranks 14. The motion of the pedals 17 will drive the driving wheel 132, which then drives the flywheel 134 to rotate.

Figure 4:
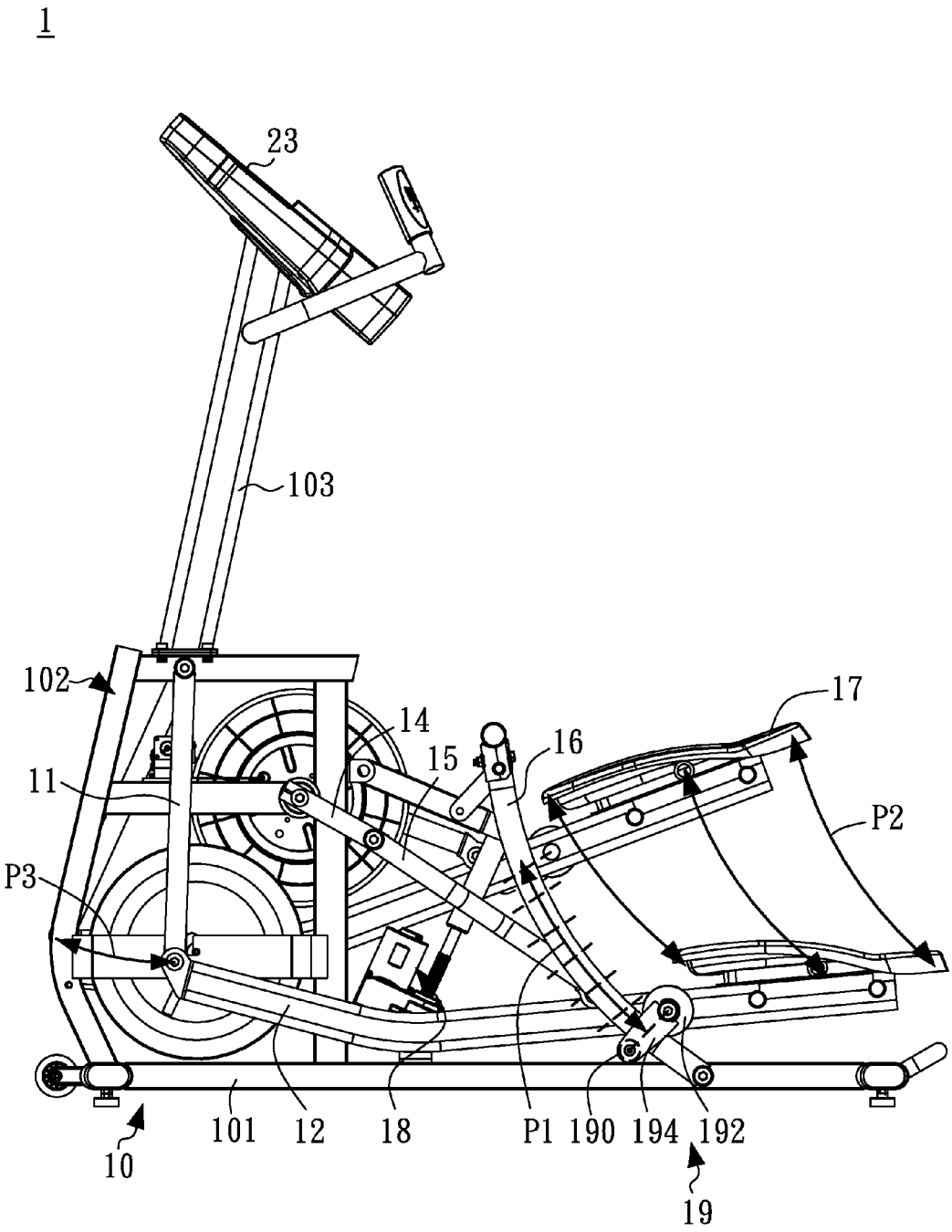
FIG. 4 is a side view showing the operation of the exercise device of FIG. 2.

Referring to FIGS. 2 and 3, preferably the exercise device 1 further comprises two roller assemblies 19. Each roller assembly 19 comprises a front roller 190 and a rear roller 192, and the axle of the rear roller 192 pivotally couples with one of two second swing arms 12. The front roller 190 and the rear roller 192 may be arranged at the front and rear of the limiting rod 16, and are configured to fit the limiting rod 16. Preferably, both the front roller 190 and the rear roller 192 have a recess to fit the limiting rod 16. In addition, each roller assembly 19 may comprise a board structure 194 to fix the front roller 190 and the second roller 192. In particular, the front roller 190 pivotally couples with the board structure 194, the rear roller 192 pivotally couples with the second swing arm 12 and the board structure 194, and the size of the rear roller 192 may be smaller than the size of the front roller 190. By doing so, the front roller 190 and the rear roller 192 can be tightly against the limiting rod 16, and each pedal 17 can be moved along a path defined by the corresponded limiting rod 16. FIG. 4 shows that the roller assembly 19 has a moving path P1 and drags the pedal 17 moving along an arc-shaped moving path P2.

Furthermore, the inclination of the roller assembly 19 is variable and therefore the inclination of the pedal 17 is also variable due to connection with the roller assembly 19. In detail, when the pedal 17 is moved to the lowest position, the rear portion of the pedal 17 will be lifted a bit or the whole pedal 17 is near horizontal. When the pedal 17 is moved to the highest position, the rear portion of the pedal 17 will be lifted considerably. That is, the inclination of the pedal 17 at the lowest position is smaller the inclination of the pedal 17 at the highest position. This variable inclination is quite ergonomic for simulating stepping, striding, or stair-climbing, and therefore the user can operate the exercise devise easily and safely. When the roller assembly 19 is moved to the highest position, the degree of the inclination of the roller assembly is small; when the roller assembly 19 is moved to the lowest position, the degree of the inclination of the roller assembly 19 is large. That is, the inclination of the roller assembly 19 at the lowest position is greater the inclination of the roller assembly 19 at the highest position. Accordingly, the roller assembly 19 can stabilize the motion of the pedal 17. The pedals 17 will not deviate from the limiting rods 16 when they are operated fast.

FIG. 4 is a side view showing the operation of the exercise device 1 of FIG. 2. Referring to FIG. 4, when the exercise device is operated, the first swing arm 11 and the link rod 15 will drag the second swing arm 12 moving along a reciprocal moving path P3. Referring to FIG. 4, the moving path P2 of the each pedal 17 of the exercise device 1 is an arc with a center toward a portion of the user, e.g., the shank or foot of the user. Compared with the conventional non-ergonomic moving path, the moving path P2 of the present invention is ergonomic. In addition, because the cranks 14 directly exert force to the second swing arms 12, the climbing force given to the pedals 17 will be sufficient and strong. With the strong climbing force and ergonomic moving path P2, the stepping, striding, or stair-climbing exercises can be realistically simulated. Furthermore, the moving path P2 is smooth and the user will feel unhindered when operating the exercise device.

Figure 5:
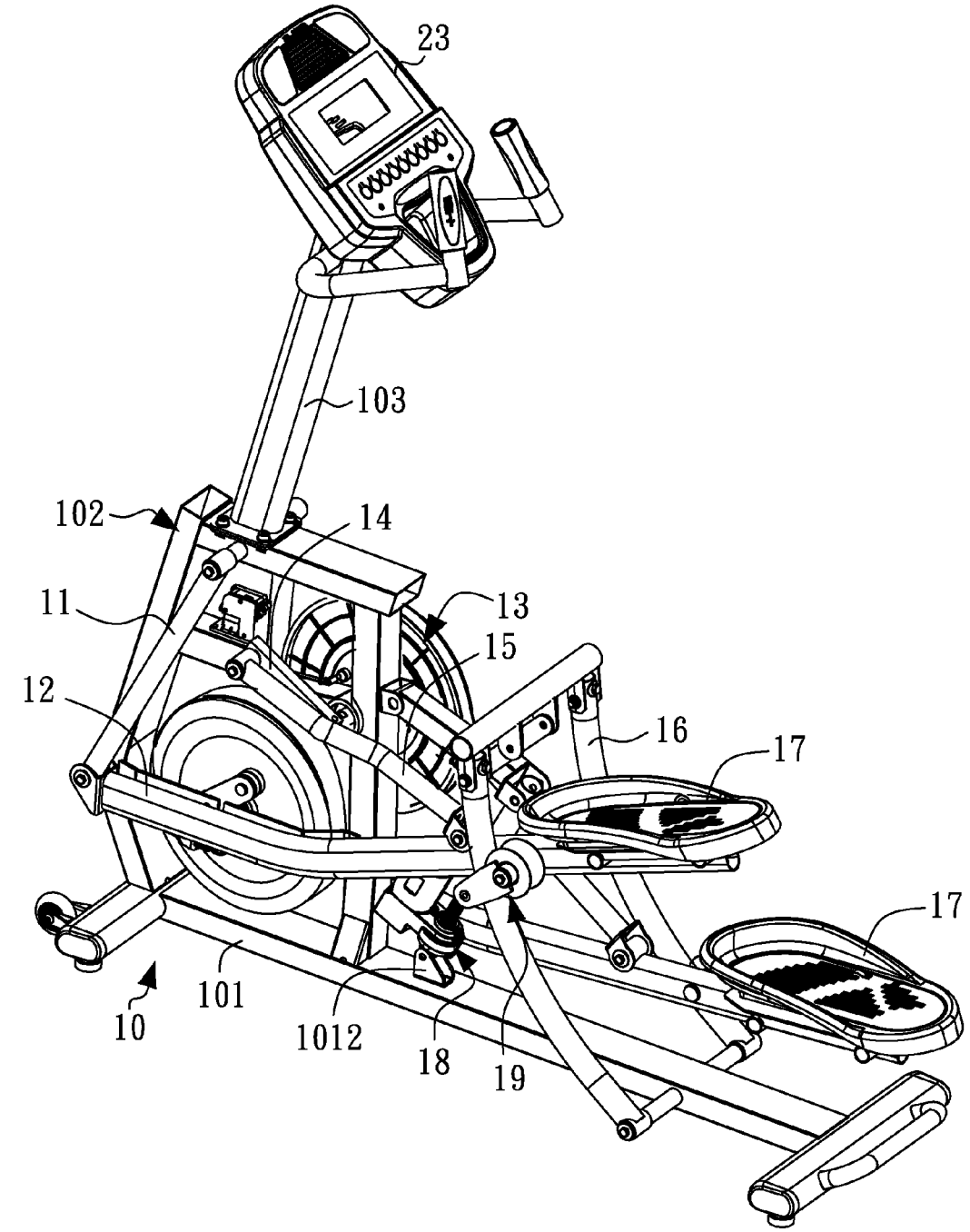
FIG. 5 is a perspective view showing the operation of the exercise device of FIG. 2.

FIG. 5 is a perspective view showing the operation of the exercise device 1 of FIG. 2. Referring to FIG. 5, when the crank 14 is operated to overlap the link rod 15, the two pedals 16 are nor at the highest and neither at lowest positions, so that the "dead point" problem can be avoid and the cranks 14 can be further moved.

Figure 6:
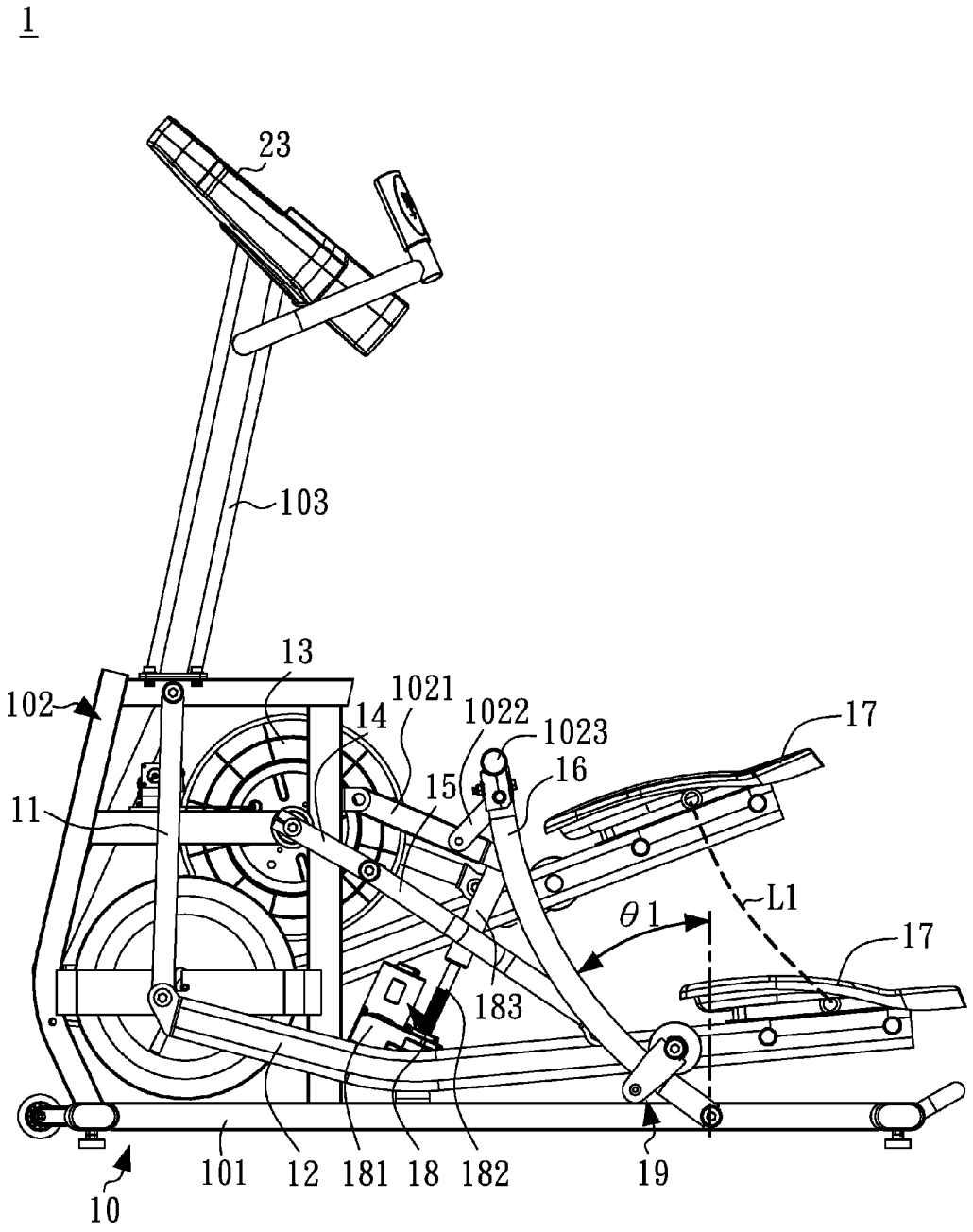
FIG. 6 is a side view showing the operation of the exercise device of FIG. 2.
Figure 7:
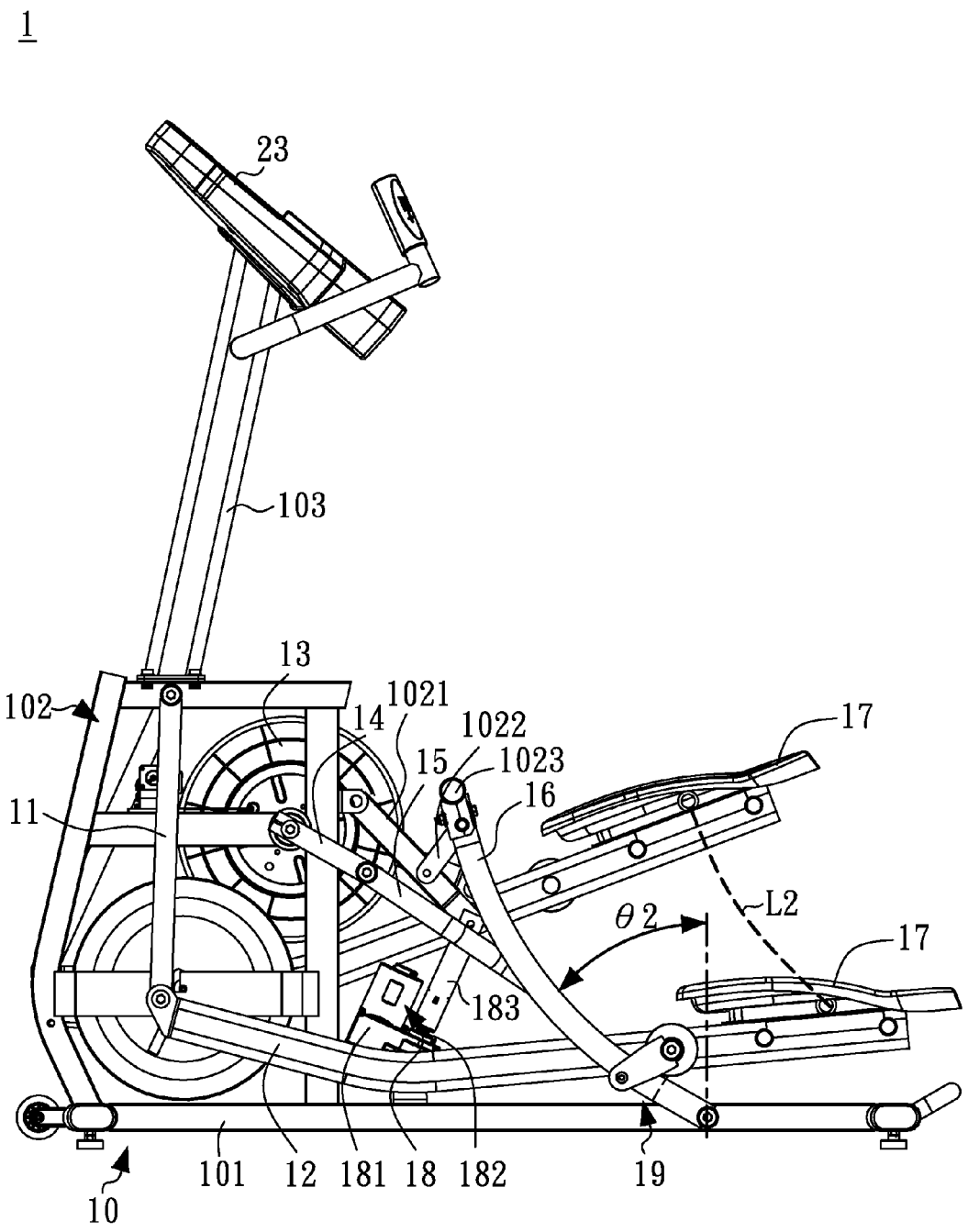
FIG. 7 is a side view showing the operation of the exercise device of FIG. 2.

FIGS. 6 and 7 are side views showing the operation of the exercise device 1 of FIG. 2. Referring to FIGS. 2, 3, 6, and 7, a first end of the stride-adjusting device 18 couples with the frame 10, such as a pivot 1012 (FIG. 2) of the base 101 of the frame 10, and a second end of the stride-adjusting device 18 movably couples with the two limiting rods 18. For example, the stride-adjusting device 18 may comprise a motor 181, a screw 182, and a tube 183. The motor 181 can drive the screw 182 to rotate, and the tube 183 has internally thread to engage with the screw 182. When the motor 181 drives the screw 182 to rotate in a counterclockwise or clockwise direction, the tube 183 is moved along the screw 182 in a direction toward the motor 181 or away from the motor 181. In addition, the stride-adjusting device 18 may employ a link assembly, such as a first linkage 1021, two second linkage 1022, and a horizontal linkage 1023, to movably couples with an end of the limiting rods 16. In detail, a first end of the first linkage 1021 pivotally couples with the supporting structure 102, and a second end of the first linkage 1021 pivotally couples with the tube 183. The two second linkages 1022 are arranged at the left side and the right side of the first linkage 1021. Each second linkage 1022 includes a first end pivotally coupling with a portion of the first linkage 1021 and a second end pivotally coupling with the horizontal linkage 1023. Each limiting rod 16 includes a first end coupling with the horizontal linkage 1023 and a second end pivotally coupling with the base 101 of the frame 10.

Referring to FIG. 6, when the motor 181 drives the screw 182 to rotate, the tube 183 is moved along the screw 182 in a direction away from the motor 181. At this state, an angle between the limiting rod 16 and the vertical direction is θ1, and a stride L1 (a distance between the two pedals 17) is the maximum stride of the exercise device 1. Referring to FIG. 7, when the motor 181 drives the screw 182 to rotate, the tube 183 is moved along the screw 182 in a direction toward the motor 181. At this state, the angle between the limiting rod 16 and the vertical direction is increased from θ1 to θ2, and the stride of the exercise device 1 is decreased to a minimum stride L2. The user may adjust the limiting rods 16 via the operating interface 23, and a suitable stride may be obtained when the angle between the liming rods 16 and the vertical direction is controlled between θ1 and θ2.

Modifications, variants, and equivalents may be made to the above embodiment by a person skilled in the art, and those modifications, variants, and equivalents are within the scope of the present invention. In another embodiment, the angle between the limiting rods 16 and the vertical direction may be controlled between 10° and 60° instead of between θ1 and θ2. In another embodiment, the stride-adjusting device 18 may be pivotally coupled with the supporting structure 102 of the frame 10 instead of the base 101 of the frame 10. In another embodiment, the stride-adjusting device 18 may directly couples with the horizontal linkage 1023 without using the link assembly (e.g., the first linkage 1021 and the two second linkages 1022). In another embodiment, the stride-adjusting device 18 movably couples with the lower end of the limiting rods 16 instead of the upper end of the limiting rods 16.

Figure 8:
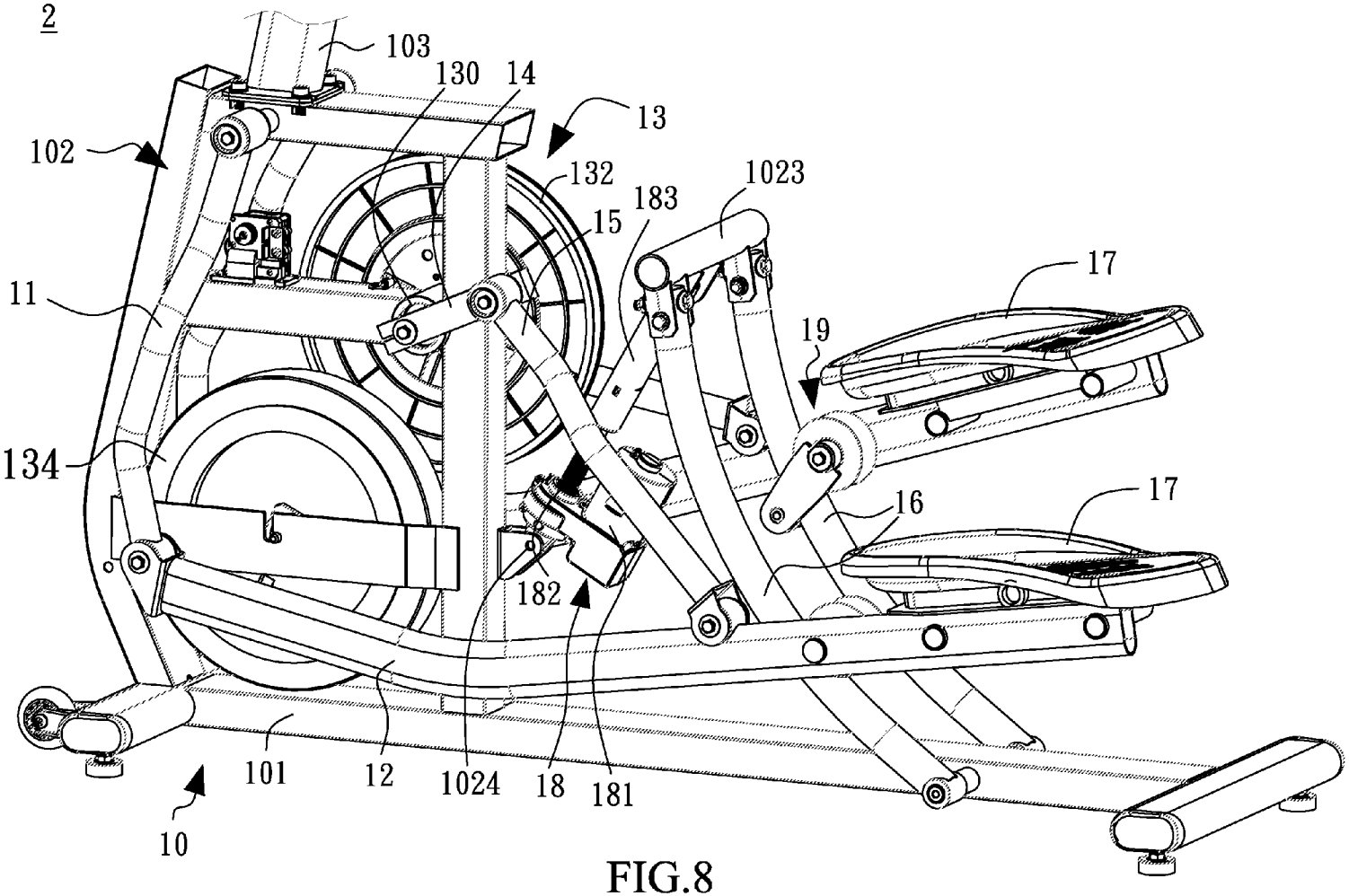
FIG. 8 is a partially perspective view showing an exercise device according to a second embodiment of the present invention.
Figure 9:
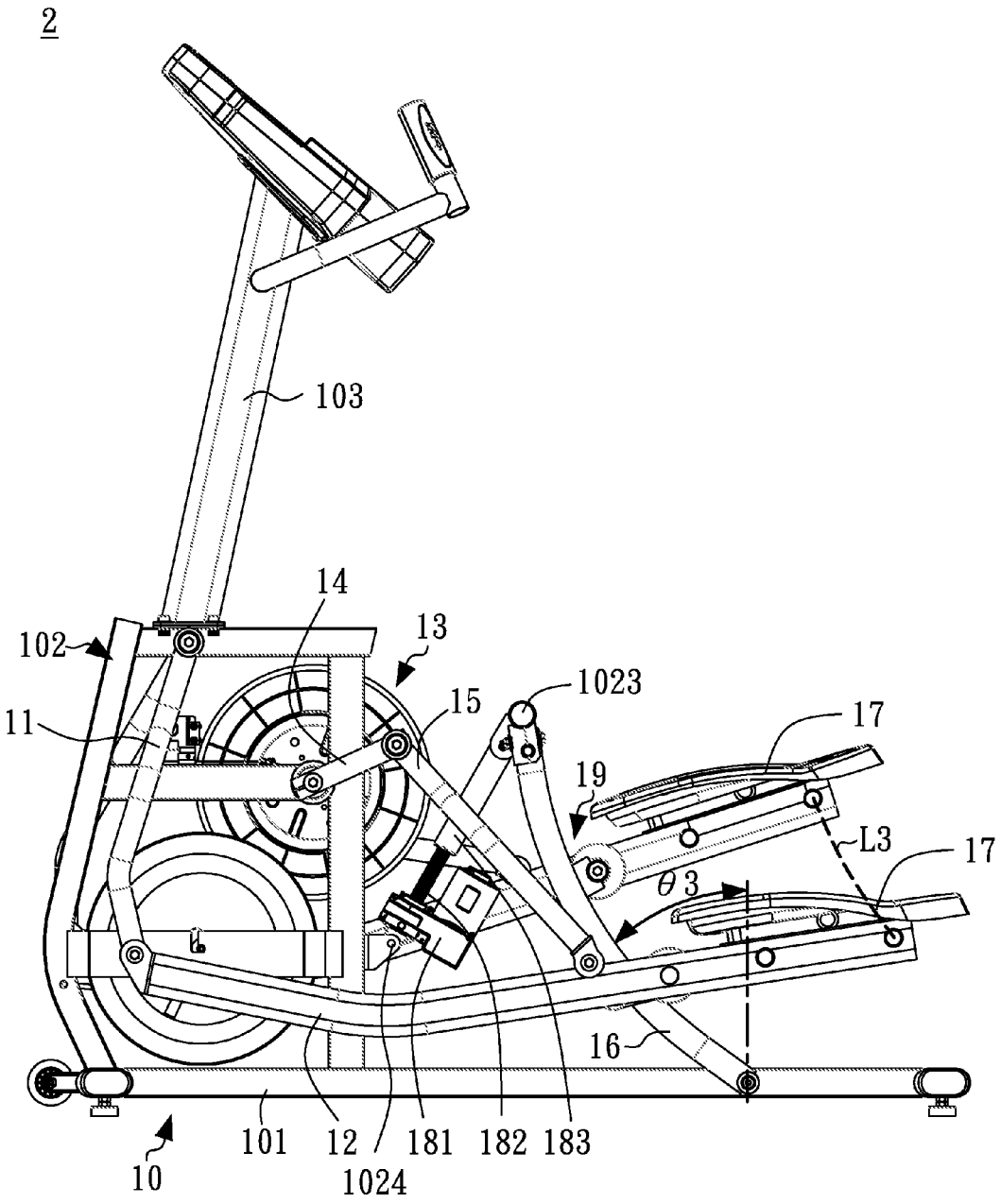
FIG. 9 is a side view showing the operation of the exercise device of FIG. 8.
Figure 10:
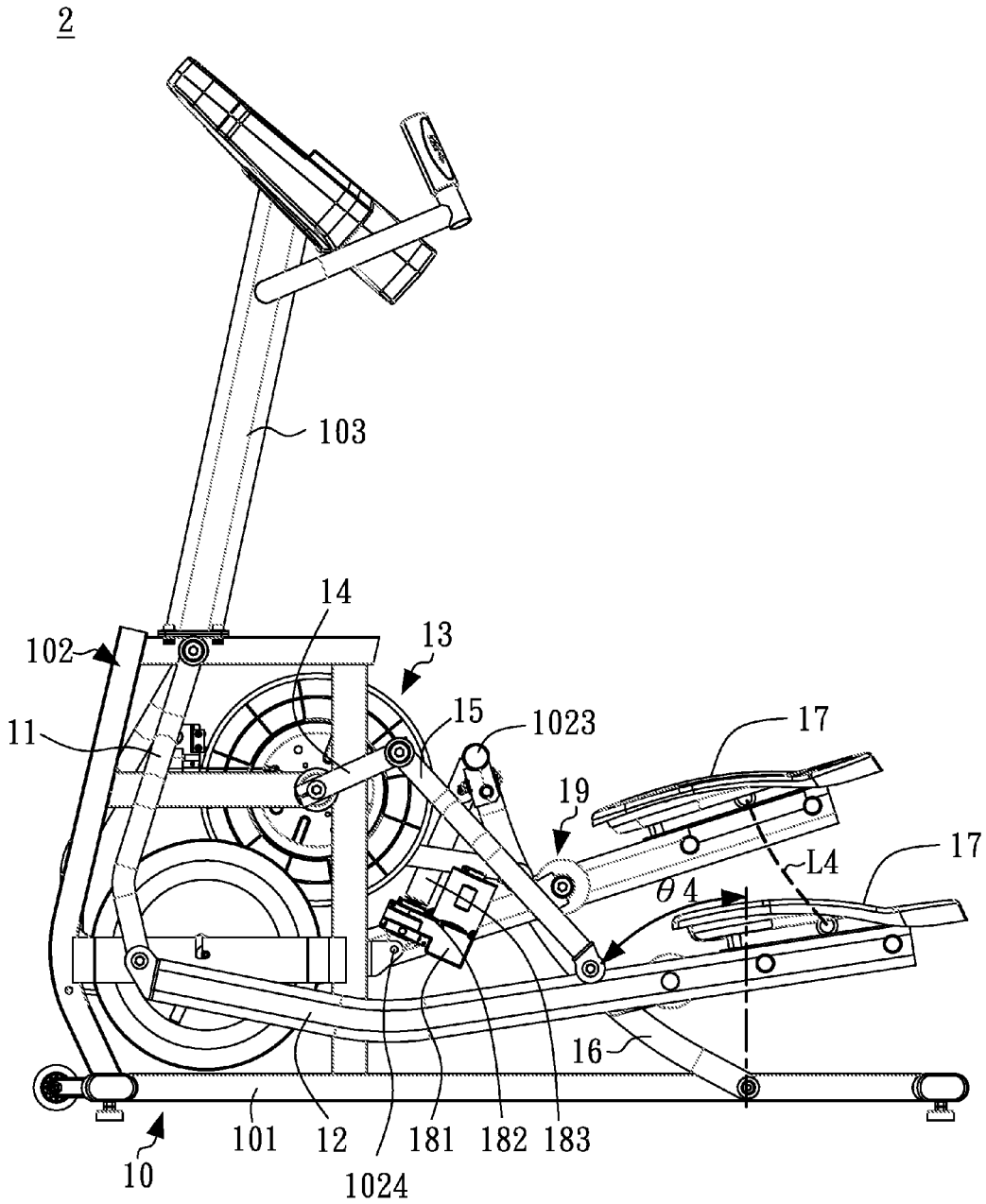
FIG. 10 is a side view showing the operation of the exercise device of FIG. 8.

FIGS. 8, 9, and 10 are partially perspective and side views showing an exercise device 2 according to a second embodiment of the present invention.

Referring to FIG. 8, the exercise device 2 differs from the exercise device 1 in the relationship between the stride-adjusting device 18 and the limiting rods 16. In this embodiment, an end of the stride-adjusting device 18 pivotally couples with the frame 10, e.g., coupling with a pivot 1024 of the supporting structure 102 of the frame 10. And another end of the stride-adjusting device 18 movably couples with the limiting rods 16. The stride-adjusting device 18 may comprises the mentioned motor 181, screw 182, and tube 183. The stride-adjusting device 18 may movably couples with an end of the limiting rods 16 via a horizontal linkage 1023. In detail, the tube 183 couples with the horizontal linkage 1023, the horizontal linkage 1023 couples with the first end of each of the two limiting rods 16, and the second end of each of the two limiting rods 16 pivotally couples with the base 101 of the frame 10. Notice that in another embodiment, an end of the stride-adjusting device 18 pivotally with the base 101 instead of the supporting structure 102 of the frame 10.

Referring to FIG. 9, when the motor 181 drives the screw 182 to rotate, the tube 183 is moved along the screw 182 in a direction away from the motor 181. At this state, an angle between the limiting rod 16 and the vertical direction is θ3, and a stride L3 (a distance between the two pedals 17) is the maximum stride of the exercise device 1. Referring to FIG. 10, when the motor 181 drives the screw 182 to rotate, the tube 183 is moved along the screw 182 in a direction toward the motor 181. At this state, the angle between the limiting rod 16 and the vertical direction is increased from θ3 to θ4, and the stride of the exercise device 1 is decreased to a minimum stride L4. The user may adjust the limiting rods 16 via the operating interface 23, and a suitable stride may be obtained when the angle between the liming rods 16 and the vertical direction is controlled between θ3 and θ4.

Figure 11:
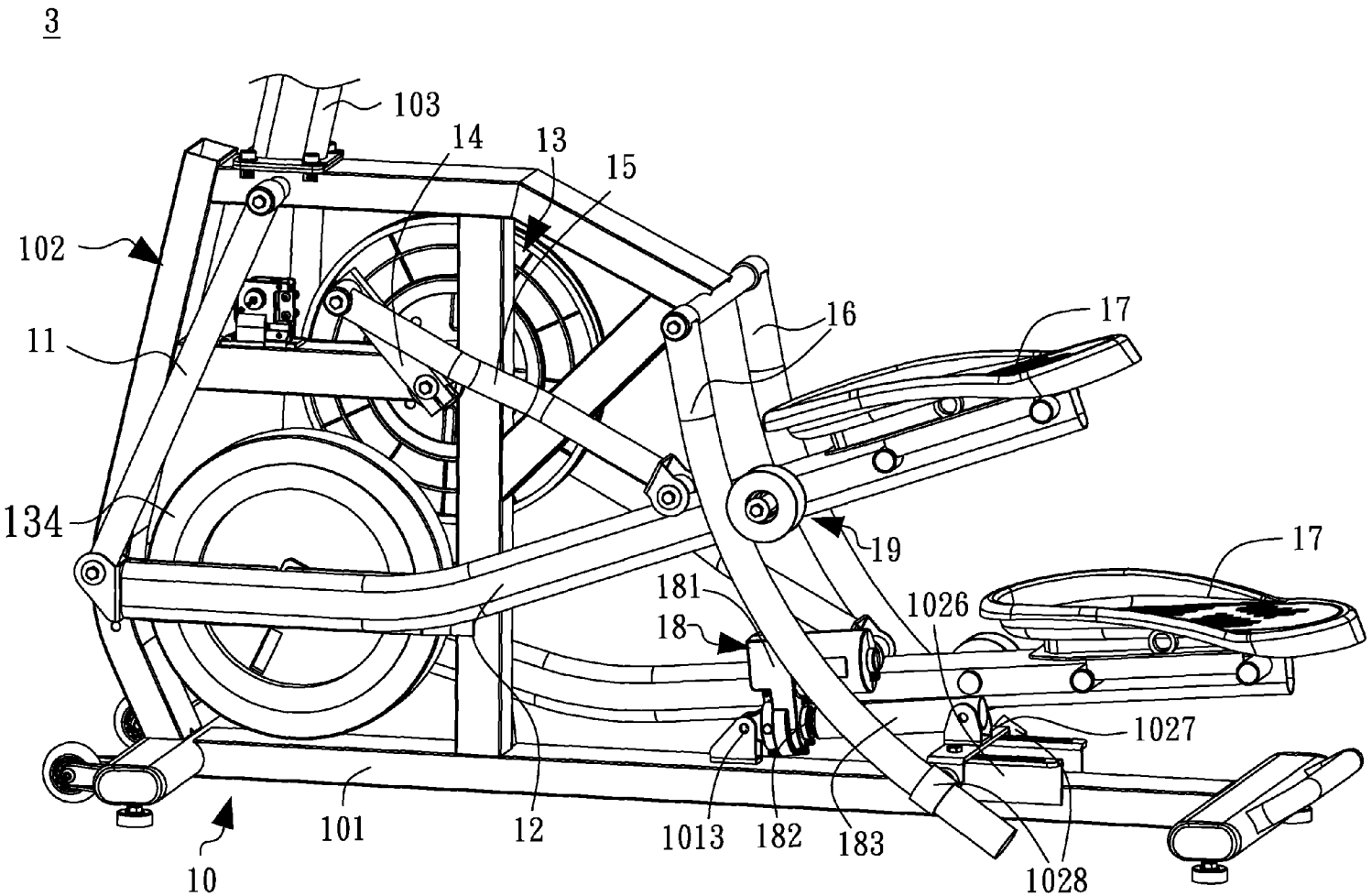
FIG. 11 is a partially perspective view showing an exercise device according to a third embodiment of the present invention.
Figure 12:
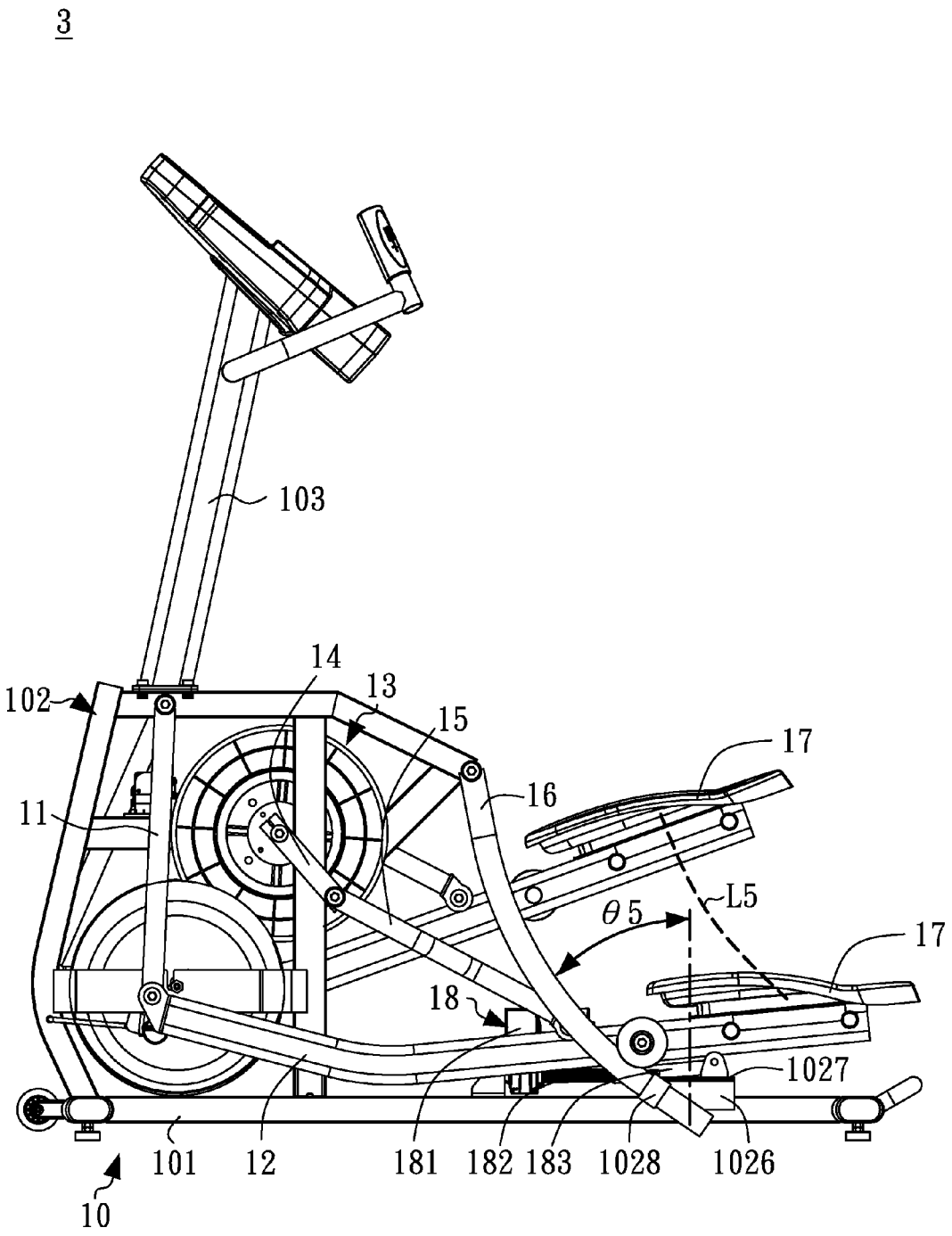
FIG. 12 is a side view showing the operation of the exercise device of FIG. 11.
Figure 13:
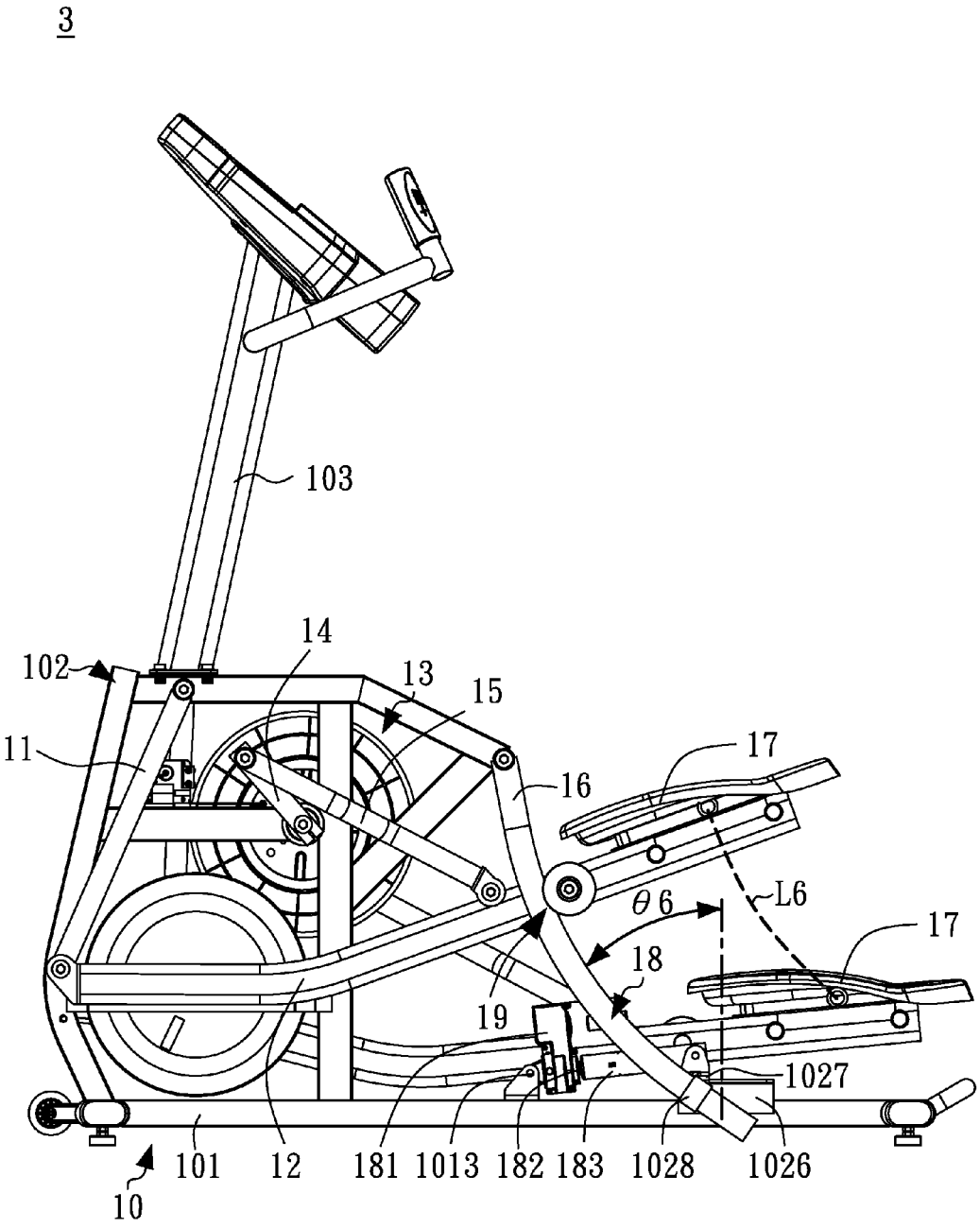
FIG. 13 is a side view showing the operation of the exercise device of FIG. 11.

FIGS. 11, 12, and 13 are partially perspective and side views showing an exercise device 3 according to a third embodiment of the present invention.

Referring to FIG. 11, the exercise device 3 differs from the exercise device 1 in the relationship between the stride-adjusting device 18 and the limiting rods 16. In this embodiment, an end of the stride-adjusting device 18 pivotally couples with the frame 10, e.g., coupling with a pivot 1013 of the base 101 of the frame 10. And another end of the stride-adjusting device 18 movably couples with an end of the limiting rods 16, e.g., the lower end of the limiting rod 16. The stride-adjusting device 18 may comprises the mentioned motor 181, screw 182, and tube 183. The stride-adjusting device 18 may movably couples with an end of the limiting rods 16 via a plate 1027. In detail, the tube 183 couples with the plate 1027, a track 1026 is mounted on the base 101, and the plate 1027 is arranged on the track 1026 and can slide forward and backward on the track 1026. In addition, two rings 1028 couple with a left end and a right end of the plate 1027, respectively, an upper end of each limiting rod 16 pivotally couples with the supporting structure 102, and a lower end of each limiting rod 16 passes through a corresponded ring 1028. By such arrangement, the stride-adjusting device 18 can control the angle between the limiting rods 16 and the vertical direction.

Referring to FIG. 12, when the motor 181 drives the screw 182 to rotate, the tube 183 is moved along the screw 182 in a direction away from the motor 181. At this state, an angle between the limiting rod 16 and the vertical direction is θ5, and a stride L5 (a distance between the two pedals 17) is the maximum stride of the exercise device 1. Referring to FIG. 13, when the motor 181 drives the screw 182 to rotate, the tube 183 is moved along the screw 182 in a direction toward the motor 181. At this state, the angle between the limiting rod 16 and the vertical direction is decreased from θ5 to θ6, and the stride of the exercise device 1 is decreased to a minimum stride L6. The user may adjust the limiting rods 16 via the operating interface 23, and a suitable stride may be obtained when the angle between the liming rods 16 and the vertical direction is controlled between θ5 and θ6.

Notice that in another embodiment of the present invention, the track 1026 is omitted, and the plate 1027 is placed on the base 101 and can slide forward and backward on the base 101. The other details of this embodiment are the same as the third embodiment and thus are omitted.

Accordingly, the stride-adjusting device 18 of the exercise devices 1/2/3 of the present invention can adjust the position of an end of the two limiting rods, so as to obtain a suitable stride.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exercise device, comprising:

a frame;

two first swing arms respectively arranged at a left side and a right side of the frame, each first swing arm having a first end pivotally coupling with the frame;

two second swing arms coupling with the two first swing arms, each first swing arm having a second end pivotally coupling with a first end of one corresponded second swing arm;

two pedals coupling with the two second swing arms, each second swing arm having a second end coupling with one corresponded pedal;

a resistance device pivoted to the frame by an axle for providing a resistance;

two cranks respectively arranged at a left side and a right side of the resistance device, each crank having a first end coupling with the axle of the resistance device;

two link rods coupling with the two cranks and the two second swing arms, each link rod having a first end and a second end, the first end of each link rod coupling with a second end of one corresponded crank, the second end of each link rod coupling with a portion of one corresponded second swing arm;

two limiting rods, each limiting rod having a first end pivotally coupling with the frame, the two pedals slidably coupling with two limiting rods;

a stride-adjusting device having a first end coupling with the frame and a second end movably coupling with a second end of each of the two limiting rods.

2. The exercise device of claim 1, wherein the stride-adjusting device comprises a motor, a screw, and a tube, the tube has internally thread to engage with the screw, and the motor can drive the screw to rotate, so that the tube is moved along the screw in a direction toward the motor or away from the motor.

3. The exercise device of claim 2, wherein the frame comprises a base and a supporting structure, the base is arranged on a supporting plane or ground, and the supporting structure is arranged on the base.

4. The exercise device of claim 3, wherein an end of the motor pivotally couples with the supporting structure of the frame, an end of the tube couples with a horizontal linkage, and an end of each of the two limiting rods couples with the horizontal linkage.

5. The exercise device of claim 3, further comprising a first linkage, two second linkages, and a horizontal linkage, wherein an end of the motor pivotally couples with the base of the frame, a first end of the first linkage pivotally couples with the supporting structure of the frame, a second end of the first linkage pivotally couples with the tube, the two second linkages are respectively arranged at a left side and a right side of the first linkage, a first end of each of the two second linkages couples with a portion of the first linkage, a second end of each of the two second linkages couples with the horizontal linkage, a first end of each of the two limiting rods couples with the horizontal linkage, and a second end of each of the two limiting rods pivotally couples with the base of the frame.

6. The exercise device of claim 3, further comprising a plate, a track, and two rings, wherein an end of the motor pivotally couples with the base, the tube pivotally couples with the plate, the track is mounted on the base, and the plate is arranged on the track and can slide on the track, the two rings respectively couple to a left end and a right end of the plate, a first end of each of the two limiting rods pivotally couples with the supporting structure, and a second end of each of the two limiting rods passes through one of the two rings.

7. The exercise device of claim 3, further comprising a plate and two rings, wherein an end of the motor pivotally couples with the base, the tube pivotally couples with the plate, the plate is arranged on the base and can slide on the base, the two rings respectively couple to a left end and a right end of the plate, a first end of each of the two limiting rods pivotally couples with the supporting structure, and a second end of each of the two limiting rods passes through one of the two rings.

8. The exercise device of claim 1, wherein each limiting rod is arc-shaped with a center toward a portion of a user of the exercise device.

9. The exercise device of claim 1, wherein the greater is an angle between the two limiting rods and a vertical direction, the shorter is a stride between the two pedals.

10. The exercise device of claim 1, wherein the smaller is an angle between the two limiting rods and a vertical direction, the shorter is a stride between the two pedals.

11. The exercise device of claim 1, wherein each pedal has an inclination, and the inclination of the pedal at the lowest position is smaller the inclination of the pedal at the highest position.

12. The exercise device of claim 1, further comprising two roller assembly, each roller assembly coupling with one of the two second swing arms and silably coupling with one of the two limiting rods, wherein each roller assembly comprises a front roller, a board structure, and a rear roller, the front roller and the rear roller are pivotally coupled with the board structure and are respectively arranged at a front and a rear of one corresponded limiting rod.

* * * * *